US007341689B2

(12) United States Patent
Engström et al.

(10) Patent No.: US 7,341,689 B2
(45) Date of Patent: Mar. 11, 2008

(54) PRE-ALLOYED IRON BASED POWDER

(75) Inventors: Ulf Engström, Johnstown, PA (US); Sigurd Berg, Höganäs (SE)

(73) Assignee: Höganäs AB, Höganäs (SE)

( * ) Notice: Subject to any disclaimer, the term of this patent is extended or adjusted under 35 U.S.C. 154(b) by 16 days.

(21) Appl. No.: 11/316,869

(22) Filed: Dec. 27, 2005

(65) Prior Publication Data

US 2006/0099105 A1 May 11, 2006

Related U.S. Application Data

(62) Division of application No. 10/208,819, filed on Aug. 1, 2002, now abandoned.

(30) Foreign Application Priority Data

Jun. 14, 2002 (SE) ..... 0201824

(51) Int. Cl.
*B22F 3/12* (2006.01)

(52) U.S. Cl. ..... 419/11; 419/36; 419/39; 75/337

(58) Field of Classification Search ..... 419/11, 419/36, 39
See application file for complete search history.

(56) References Cited

U.S. PATENT DOCUMENTS

| | | | | |
|---|---|---|---|---|
| 3,887,402 | A * | 6/1975 | Kondo et al. | 148/513 |
| 4,266,974 | A | 5/1981 | Nitta et al. | |
| 4,381,940 | A | 5/1983 | Watanabe et al. | |
| 4,382,818 | A | 5/1983 | Mocarski | |
| 4,437,891 | A | 3/1984 | Umino et al. | |
| 5,180,450 | A | 1/1993 | Rao | |
| 5,605,559 | A | 2/1997 | Unami et al. | |
| 5,666,634 | A | 9/1997 | Unami et al. | |
| 6,068,813 | A | 5/2000 | Semel | |
| 6,261,514 | B1 | 7/2001 | Lindberg et al. | |
| 6,348,080 | B1 | 2/2002 | Arvidsson et al. | |
| 6,355,087 | B1 | 3/2002 | Arvidsson et al. | |
| 6,365,095 | B1 * | 4/2002 | Bergkvist | 419/48 |

FOREIGN PATENT DOCUMENTS

| | | |
|---|---|---|
| JP | 04-165002 | 6/1992 |
| SE | 412 257 | 2/1980 |
| WO | WO 98/03291 | 1/1998 |

OTHER PUBLICATIONS

K.U. Kainer et al. "Oil Atomization—A Method for the Production of Rapidly Solidified Iron-Carbon Alloys", Metal Powder Report (Jan. 1989), pp. 28-31.

* cited by examiner

*Primary Examiner*—Roy King
*Assistant Examiner*—Ngoclan T. Mai
(74) *Attorney, Agent, or Firm*—Buchanan Ingersoll & Rooney PC

(57) ABSTRACT

The invention concerns a new pre alloyed steel powder comprising in addition to iron and inevitable impurities, by wt %, 1.3-1.7% by weight of Cr, 0.15-0.3% by weight of Mo, 0.09-0.3% by weight of Mn, not larger than 0.01 by weight of C, not larger than 0.25% of O.

20 Claims, 4 Drawing Sheets

Tensile strength versus carbon content

PRE-ALLOYED IRON BASED POWDER

CROSS-REFERENCE TO RELATED APPLICATIONS

This application is a divisional application under 35 U.S.C. § 120 of Ser. No. 10,208,819, filed Aug. 1, 2002, which is hereby incorporated by reference in its entirety, which claims priority under 35 U.S.C. § 119 to Swedish Application No. 0201824-0, filed Jun. 14, 2002, which is hereby incorporated by reference in its entirety.

FIELD OF INVENTION

The present invention concerns a pre-alloyed iron based powder. Particularly the invention concerns a pre-alloyed iron based powder including small amounts of alloying elements which permits a cost effectively manufacture of sintered parts for an increasing P/M market.

BACKGROUND OF THE INVENTION

In industry the use of metal products manufactured by compacting and sintering metal-powder compositions is becoming increasingly widespread. A number of different products of varying shapes and thickness are being produced and the quality requirements are continuously raised at the same time as it is desired to reduce the costs. This is particularly true for P/M parts for the automotive market, which is an important market for the P/M industry and for which cost is a major driving force. Another factor of importance is the possibility of recycling scrap from the automotive industry and to consider the effect on the environment. Known alloying systems which have gained wide acceptance within this field have frequently included alloying elements such as Ni and Cu. However, nickel is a strong allergen and is also considered to have other detrimental medical effects. A problem with copper is that, during recycling of scrap used for steel manufacture, copper is accumulated. In many steel qualities copper is however not suitable and scrap without copper or with a minimum of copper would be required. Iron-based powders having low amounts of alloying elements without nickel and copper are previously known from e.g. the U.S. Pat. Nos. 4,266,974, 5,605,559, 5,666,634 and 6,348,080 (Arvidsson)

The purpose of the invention according to the U.S. Pat. No. 4,266,974 is to provide a powder satisfying the demands of high compressibility and moldability of the powder and good heat-treatment properties, such as carburising, hardenability, in the sintered body. The most important step in the production of the steel alloy powder produced according to this patent is the reduction annealing step (col. 5 line 15).

The U.S. Pat. Nos. 5,605,559 and 5,666,634 both concern steel powders including Cr, Mo and Mn. The alloy steel powder according to the U.S. Pat. No. 5,605,559 comprises, by wt %, about 0.5-2% of Cr, not greater than about 0.08% of Mn, about 0.1-0.6% of Mo, about 0.05-0.5% of V, not greater than about 0.015 of S, not greater than about 0.2% of 0, and the balance being Fe and incidental impurities. The U.S. Pat. No. 5,666,634 discloses that the effective amounts should be between 0.5 and 3% by weight of chromium, 0.1 and 2% by weight of molybdenum and at most 0.08% by weight of manganese.

A serious drawback when using the inventions disclosed in these U.S. Pat. Nos. 5,605,559 and 5,666,634 is that cheap scrap cannot be used as this scrap normally includes more than 0.08% by weight of manganese. In this context the patent U.S. Pat. No. 5,605,559 teaches that "when Mn content exceeds about 0.08 wt % oxide is produced on the surface of alloy steel powders such that compressibility is lowered and hardenability increased beyond the required level. . . . Mn content is preferably not greater than about 0.06% wt." (col 3 47-53).This teaching is repeated in the U.S. Pat. No. 5,666,634 disclosing that "a specific treatment is used in order to reduce the Mn content to a level not larger than 0.08% by weight during the course of the steel making" (col. 3 line 40-44). Another problem is that nothing is taught about the reduction annealing and the possibility to obtain the low oxygen and carbon content in water-atomised iron powders including elements sensitive to oxidation, such as chromium, manganese. The only information given in this respect seems to be in example 1, which discloses that a final reduction has to be performed. Furthermore the U.S. Pat. No. 5,666,634 refers to a Japanese Patent Laid-open No. 4-165002 which concerns an alloy steel powder including in addition to Cr also Mn, Nb and V. This alloy powder may also include Mo in amounts above 0.5% by weight. According to the investigations referred to in the U.S. Pat. No. 5,666,634, it was found that this Cr-based alloy steel powder is disadvantageous due to the existence of the carbides and nitrides which act as sites of fracture in the sintered body.

The possibility of using powders from scrap is disclosed in the U.S. Pat. No. 6,348,080 which discloses a water-atomised, annealed iron-based powder comprising, by weight %, Cr 2.5-3.5, Mo 0.3-0.7, Mn 0.09-0.3, O<0.2, C<0.01 the balance being iron and, an amount of not more than 1%, inevitable impurities. This patent also discloses a method of preparing such a powder. Additionally the U.S. Pat. No. 6,261,514 discloses the possibility of obtaining sintered products having high tensile strength and high impact strength if powders having this composition is warm compacted and sintered at a temperature>1220° C.

The present inventors have now unexpectedly found that more narrow ranges of the alloying elements, especially chromium, will give unexpected improvements as regards the possibilities of annealing and sintering the powders in comparison with the powders disclosed in the U.S. Pat. No. 6,348,080.

Additionally, when comparing green bodies prepared from these known powders with green bodies prepared from the new powders according to the present invention it was found that the green strength of compacted bodies prepared from the new powders are distinguished by an unexpectedly high green strength. This is particularly true when die wall lubrication is used. Green strength is one of the most important physical properties of green parts. The importance of this property increases as P/M parts increase in size and geometry becomes more complex. Green strength increases with increasing compact density and is influenced by type and amount of lubricant admixed to the powder. The green strength is also influenced by the type of powder used. A high green strength is required in order to prevent compacts from cracking during the ejection from the compacting tool and prevent them from getting damaged during the handling and the transport between the press and the sintering furnace. Presently used compacts having a relatively high green strength are advantageously prepared from sponge iron powders whereas difficulties have been met as regards the preparation of compacts of atomised powders in spite of the fact that an atomised powder is more compressible and hence gives a higher green density.

OBJECTS OF THE INVENTION

An object is to provide a new pre-alloyed powder including low amounts of alloying elements.

A second object is to provide a pre-alloyed powder which is essentially free from nickel and copper.

A third object is to provide a pre-alloyed powder which can be compacted at both ambient temperature and at elevated temperature to high green strength at moderate compaction pressures.

A further object is to provide a pre-alloyed powder which can be produced from cheap scrap.

Still another object is to provide a new pre-alloyed powder which can be cost effectively compacted and sintered in industrial scale.

SUMMARY OF THE INVENTION

According to the present invention these objects are achieved by a pre alloyed steel powder comprising, 1.3-1.7% by weight of Cr 0.15-0.3% by weight of Mo 0.09-0.3% by weight of Mn not larger than 0.01 by weight of C not larger than 0.25% of O and the balance being inevitable impurities and Fe.

According to a more preferred embodiment of the invention the powder has the composition 1.35-1.65% by weight of Cr 0.17-0.27% by weight of Mo, 0.09-0.2% by weight of Mn not larger than 0.006 by weight of C.

DETAILED DESCRIPTION OF THE INVENTION

Amount of Cr

Figure 1:
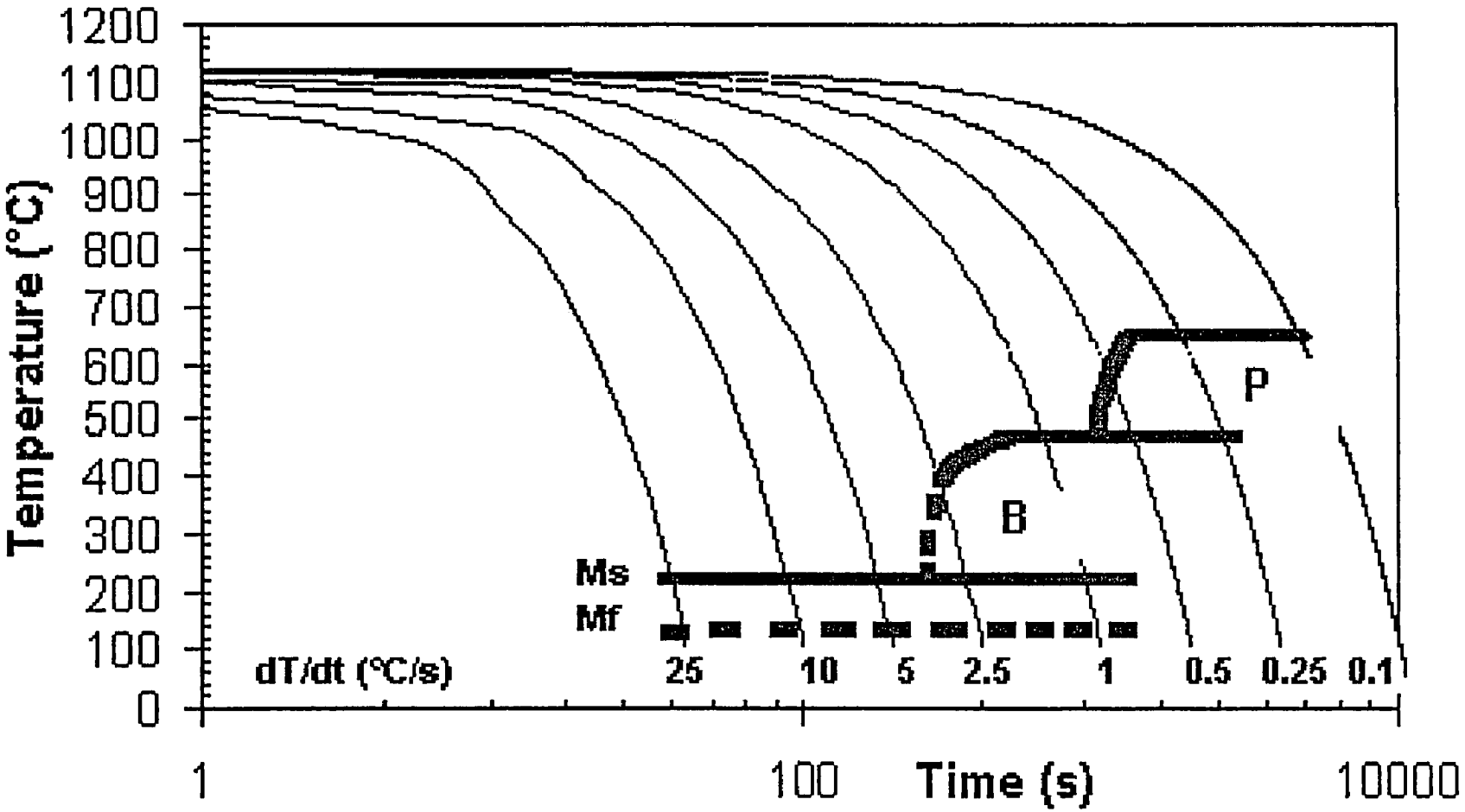
FIG. 1 shows temperature versus time curves and corresponding structures.

The component Cr is a suitable alloying element in steel powders, since it provides sintered products having an improved hardenability but not significantly increased ferrite hardness. To obtain a sufficient strength after sintering and still maintain a good compressibility a Cr range of 1.3 to 1.7 is suitable. A higher chromium content decreases the compressibility and also increases the risk of forming unwanted carbides. A lower content decreases the hardenability.

Amount of Mn

The component Mn improves the strength of steel by improving hardenability and through solution hardening. However, if the amount of Mn exceeds 0.3%, the ferrite hardness will increase through solid solution hardening. If the amount of Mn is less than 0.08 it is not possible to use cheap scrap that normally has an Mn content above 0.08%, unless a specific treatment for the reduction of Mn during the course of the steel manufacturing is carried out (see above). Thus, the preferred amount of Mn according to the present invention is 0.09-0.3%. In combination with C contents below 0.01% this Mn interval gives the most interesting results.

Amount of Mo

The component Mo serves to improve the strength of steel through the improvement of hardenability and also through solution and precipitation hardening. To the given chemical composition the Mo addition in the range of 0.15 to 0.3 is sufficient to move the perlite noose in the CCT-diagram below to the right making it possible to form a bainitic structure at normally used cooling rates.

C Amount

The reason why C in the alloy steel powder is not larger than 0.01% is that C is an element which serves to harden the ferrite matrix through formation of a solid solution as penetrated in the steel. If the C content exceeds 0.01% by weight, the powder is hardened considerably, which results in a too poor compressibility for a powder intended for commercial use.

The amount of C in the sintered product is determined by the amount of graphite powder mixed with the alloy steel powder of the invention. Typically the amount of graphite added to the powders is between 0.15 and 0.9% by weight.

O Amount

The amount of O should not exceed 0.25% by weight. When O content exceeds about 0.25 wt %, oxides are formed with Cr and V which reduce strength and compressibility. O content is preferably limited to not greater than about 0.2 wt % and more preferably to not greater than about 0.15 wt %.

Other Elements

Other elements which may be included in the pre-alloyed powder are Ti, B, V and Nb. Ti, V and Nb can form carbides which will give precipitation hardening effects. B has the same effect as carbon, a solution hardening effect, and can form borides with Ti, Nb and V giving a precipitation hardening effect. The amounts of these elements are preferably, in % by weight, 0.01-0.04 of Ti, 0.01-0.04 of B, 0.05-0.3 of V and not more than 0.1 of Nb.

Ni and/or Cu may be admixed with the new powder. Alternatively particles of Cu and/or Ni may be adhered to the particles of the new powder by using a bonding agent. The addition of Ni and/or Cu permits sinter hardening in conventional sintering furnaces. Additive amounts of these alloys are limited to about 0.5-3 wt % or Ni and about 0.5-3 wt % of Cu.

Lubricant

A lubricant, is also normally mixed with the powder composition. The presently most interesting application of the new powder seems to be for the production of sintered parts compacted at ambient temperature (=cold compaction). The new powder is then mixed with cold compaction lubricants such as waxes e.g. ethylene bisstearamide, metal soaps etc. such as zinc stearate in amounts up to 1% by weight of the iron-based powder.

Compaction and Sintering

After compaction at ambient or elevated temperature at pressures normally between 400 and 800 MPa sintering may be performed as high temperature sintering e.g. sintering at temperatures above 1200° C. as high temperature sintering is beneficial for chromium containing materials. However also low temperature, i.e. temperatures below about 1220° C., preferably below 1200° C. or even below about 1150° C. sintering is sometimes preferable. The sintering times may be comparatively short, i.e. below 1 h, such as 45 minutes. Usually the sintering time is about 30 minutes.

Figure 2:
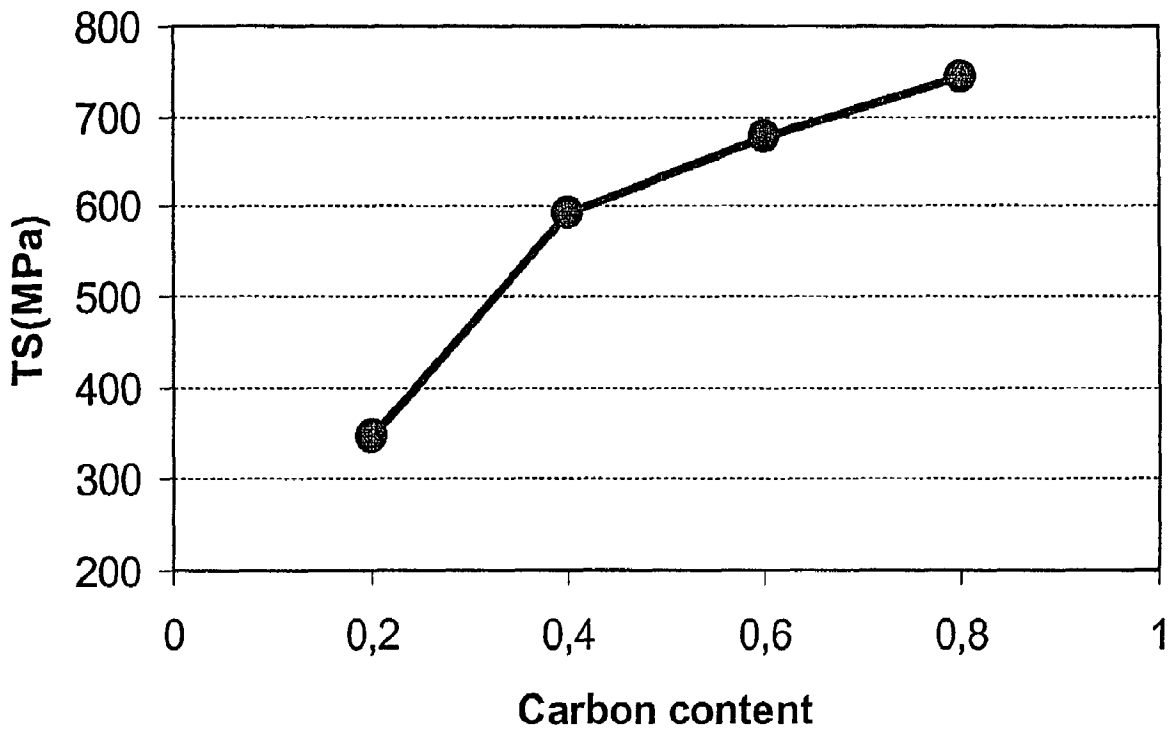
FIG. 2 shows the tensile strength as a function of carbon content at a cooling rate of 0.8° C./s.

Depending on i.a. the composition of the iron powder and the amount of graphite added, cooling rates typical for belt furnaces, i.e. 0.5-2° C./s lead to fully bainitic structures as disclosed in FIG. 1. Such a bainitic structure is desirable for a good combination of strength and toughness. FIG. 2 shows the tensile strength as a function of carbon content at a cooling rate of 0.8° C./s.

A cooling rate below 0.5° C./s results in the formation of perlite and cooling rates exceeding 3° C./s result in martensite formation.

Sinterhardening

Sinter hardening is process which might be a powerful tool in reducing the costs. New types of sintering furnaces allow low alloy steel parts to be sintered with neutral carbon potential (without decarburization or carburization) and then to be hardened in a rapid cooling zone. The heat treatment is achieved by high speed circulation of a water cooled protective gas in the rapid cooling zone of the furnace with cooling rates of up to 7° C./sec achievable between 900° C. and 400° C. This results in a homogeneous martensitic structure in the PM steels. In order to take advantage of the advantages of the sinter hardening the selection of alloying system is of outmost importance.

It has now been found that at a cooling rate above 7° C./s the new powders—if including about 0.6% by weight of carbon—have a transition to martensite. This indicates the possibility of using the new material for sinterhardening applications. For sinter hardening of the new powder in conventional mesh belt sintering furnaces equipped with a rapid cooling unit giving a cooling rate of 1-5° C./s addition of Cu and/or Ni has to be used. As indicated above suitable amounts of copper and nickel which may be used in combination with the new powder are 0.5-3%.

Figure 3:
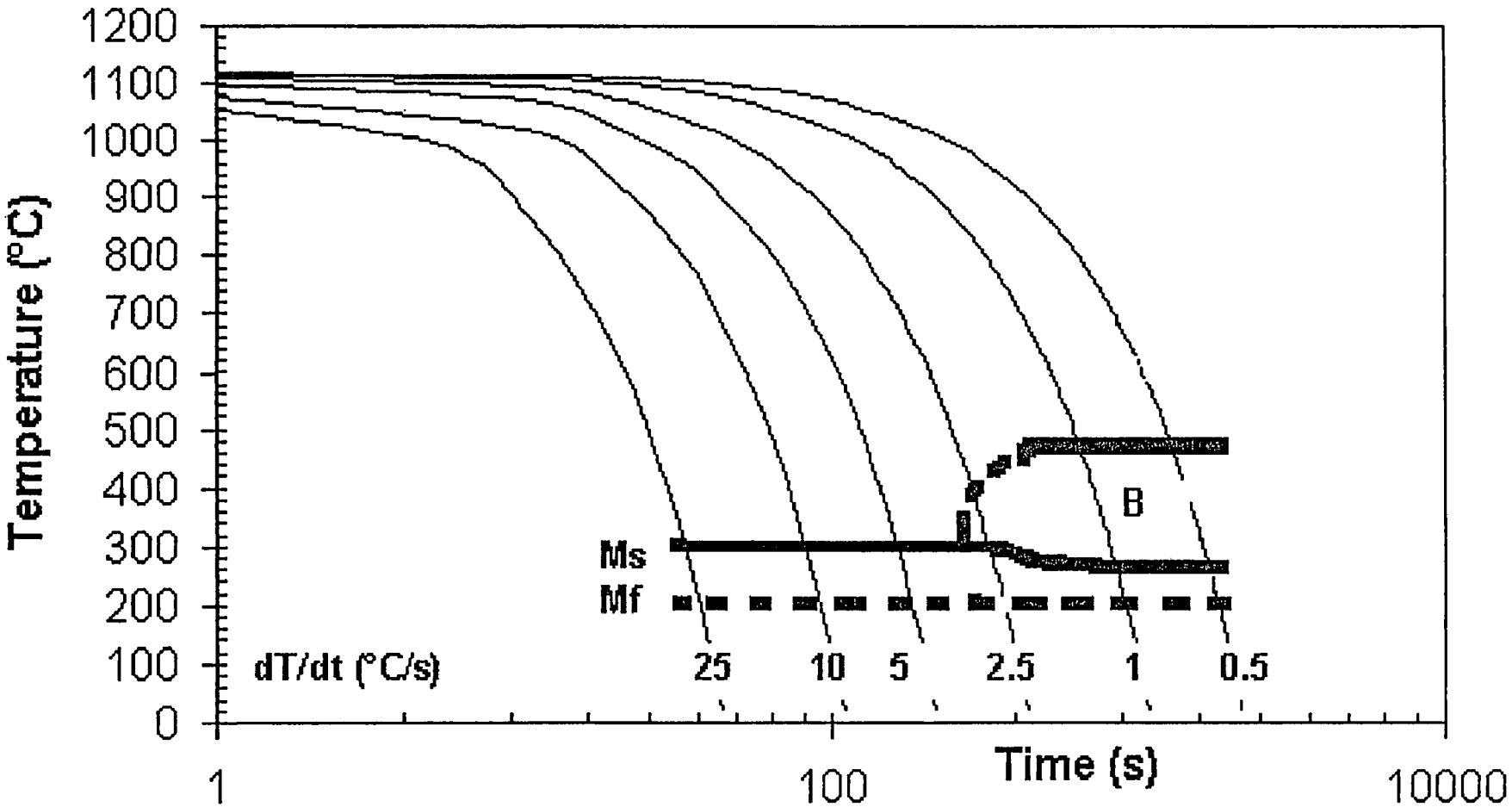
FIG. 3 shows temperature versus time curves and corresponding structures.
Figure 4:
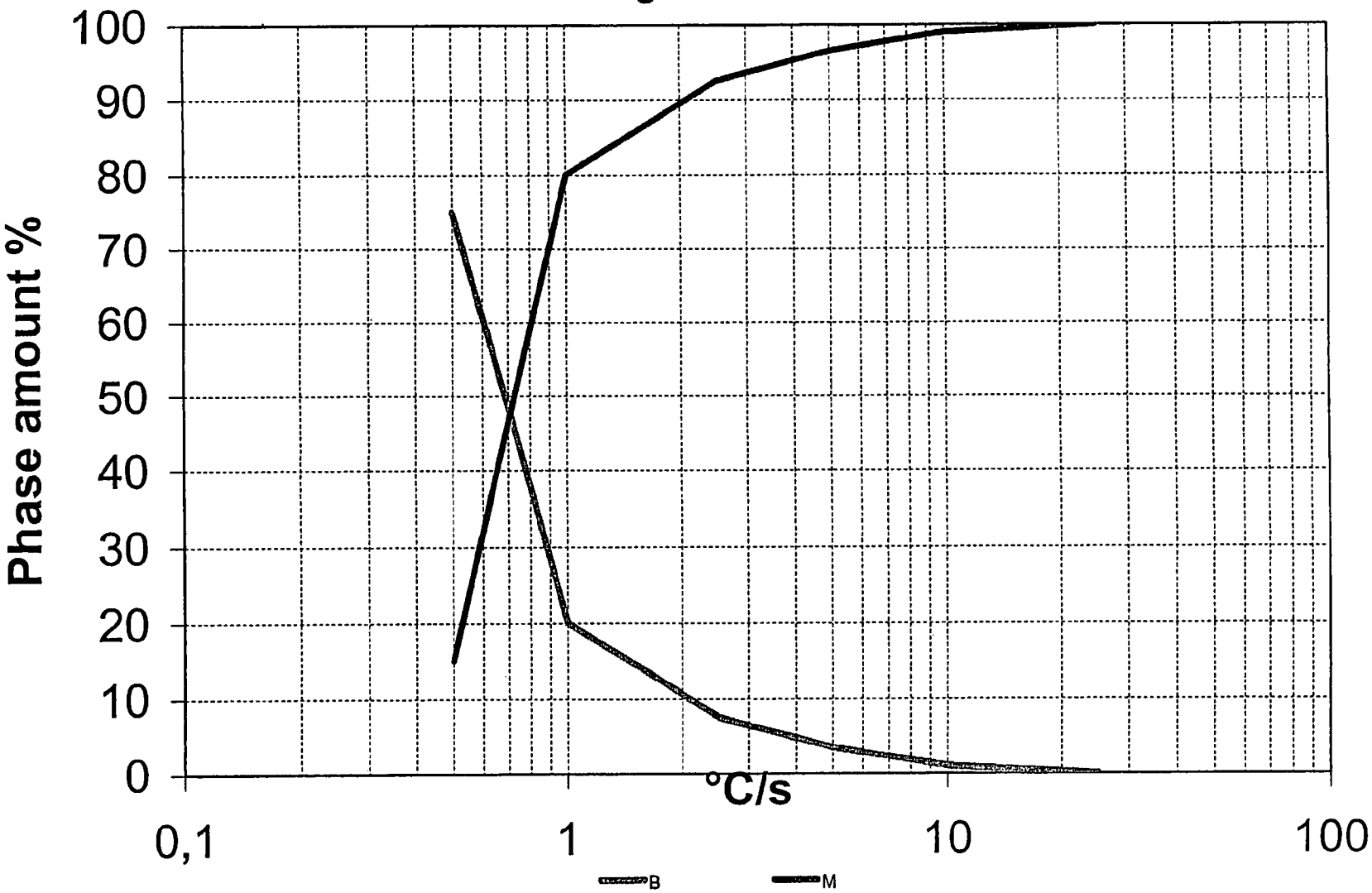
FIG. 4 shows phase amount (%) versus cooling rate curves.

FIGS. 3 and 4 disclose that a martensitic structure is obtained when the inventive powder in combination with 2% of Cu and 0.5% graphite is sinter hardenened with cooling rates of 4-5 and higher.

Preparation of the New Powder.

The alloy steel powder of the invention can be readily produced by subjecting ingot steel prepared to have the above-defined composition of alloying elements to any known water-atomising method. It is preferred that the water-atomised powder is prepared in such a way that, before annealing, the water-atomised powder has a weight ratio O:C between 1 and 4, preferably between 1.5 and 3.5 and most, preferably between 2 and 3, and a carbon content between 0.1 and 0.9% by weight. For the further processing according to the present invention this water-atomised powder could be annealed according to methods described in PCT/SE97/01292 (which is hereby incorporated by reference)

Another process which can be used for the preparation of low oxygen, low carbon iron-based powders including low amounts of easily oxidised alloying elements is disclosed in the co-pending Swedish application 9800153-0.

A distinguishing feature which has been observed concerning the appearance of the annealed powder particles is that the particle shape is slightly more irregular compared with the particle shape of water atomised plain iron powder.

The invention is further illustrated by the following non-limiting examples.

The green densities given in table 1 were obtained with a powder known from the U.S. Pat. No. 6,348,080 including 3% by weight of Cr, 0.5% by weight of Mo and 0.11% by weight of Mn.

TABLE 1

| Compaction Pressure | Die wall Lubrication Green Density | Internal lubrication ($g/cm^3$) Green Density | |
|---|---|---|---|
| (MPa) | ($g/cm^3$) | 0.8% ZnStearate | 0.6 Advawax ™ |
| 400 | 6.43 | 6.52 | 6.65 |
| 600 | 6.93 | 6.96 | 7.07 |
| 800 | 7.25 | 7.17 | 7.24 |

From the following table 2 the corresponding results obtained with a powder according to the present invention. The powder consisted of 1.5% by weight of Cr, 0.2% by weight of Mo and 0.11% by weight of Mn.

TABLE 2

| Compaction Pressure | Die wall Lubrication Green Density | Internal lubrication Green Density ($g/cm^3$) | |
|---|---|---|---|
| (MPa) | ($g/cm^3$) | 0.8% ZnStearate | 0.6% Advawax ™ |
| 400 | 6.55 | 6.61 | 6.75 |
| 600 | 7.04 | 7.02 | 7.17 |
| 800 | 7.32 | 7.21 | 7.38 |

From a comparison of the results listed in the tables 1 and 2 it can be seen that higher green densities are obtained with the new powder.

The following tables 3 and 4 disclose the corresponding green strengths for the known and new powders, respectively. The green strength which is obtained especially when the new powder is compacted in a lubricated die is remarkably higher than when the previously known powder was used.

TABLE 3

| Compaction Pressure | Die wall Lubrication Green Strength | Internal lubrication Green Strength (MPa) | |
|---|---|---|---|
| (MPa) | (MPa) | 0.8% ZnStearate | 0.6% Advawax ™ |
| 400 | 11.08 | 8.76 | 20.32 |
| 600 | 19.92 | 13.46 | 28.98 |
| 800 | 27.40 | 15.25 | 27.64 |

TABLE 4

| Compaction Pressure | Die wall Lubrication Green Strength | Internal lubrication Green Strength (MPa) | |
|---|---|---|---|
| MPa | (MPa) | 0.8% ZnStearate | 0.6% Advawax ™ |
| 400 | 21.5 | 11.3 | 19.3 |
| 600 | 38.2 | 17.3 | 29.5 |
| 800 | 53.9 | 18.8 | 32.2 |

EXAMPLE 2

The following Table 5 discloses mechanical properties of products prepared by sinterhardening (cooling rate 2.5° C./s) of the powder according to the invention in admixture with copper. The properties of the material including only 1% by weight of Cu are as good as the standard material FL 4608 according to USMPIF standard including 2% of Cu.

TABLE 5

| Added Cu(%) | Added graphite(%) | TS (MPa) | YS (MPa) | HRC | A(%) |
|---|---|---|---|---|---|
| 2 | 0.6 | 894 | 854 | 31 | 0.27 |
| 2 | 0.8 | 791 | 743 | 34 | 0.21 |
| 1 | 0.6 | 892 | 779 | 29 | 0.37 |
| 1 | 0.8 | 738 | | 35 | 0.19 |

The invention claimed is:

1. A method of making a water-atomized pre-alloyed steel powder mixture, comprising:

subjecting an ingot to a water-atomizing process to produce a water-atomized, pre-alloyed steel powder comprising, in addition to iron and inevitable impurities, by wt %:

1.3-1.7% Cr, 0.15-0.3% Mo, 0.09-0.3% Mn, not larger than 0.01% C, and less than 0.2% O; and admixing the water-atomized, pre-alloyed steel powder with a cold compaction lubricant and graphite.

2. The method of claim 1, wherein the cold compaction lubricant is selected from the group consisting of metal soaps and waxes.

3. The method of claim 1, wherein the pre-alloyed steel powder comprises, in wt %:

1.35-1.65% Cr, 0.17-0.27% Mo, 0.09-0.2% Mn, and not greater than 0.006% C.

4. The method of claim 1, wherein the pre-alloyed steel powder comprises not more than 0.15 wt % O.

5. A method of preparing a compacted green body having high green strength, comprising:

mixing a cold compaction lubricant and graphite with a water-atomized, pre-alloyed steel powder comprising, in addition to iron and inevitable impurities, by wt %:

1.3-1.7% Cr, 0.15-0.3% Mo, 0.09-0.3% Mn, not greater than 0.01% C, and not greater than 0.25% O; and compacting the mixture at ambient temperature to form a green body.

6. The method of claim 5, wherein the pre-alloyed steel powder comprises not greater than 0.2 wt % O.

7. The method of claim 5, wherein the pre-alloyed steel powder comprises not greater than 0.15 wt % O.

8. The method of claim 5, wherein the compacted green body has a green density of at least 7.1 g/cm$^3$.

9. The method of claim 5, wherein the compacted green body has a green density of at least 7.2 g/cm$^3$.

10. The method of claim 5, wherein the compacted green body has a green density of at least 7.3 g/cm$^3$.

11. The method of claim 5, wherein the compaction pressure is from 400 MPa to 800 MPa.

12. The method of claim 8, wherein the green body is compacted at a compaction pressure of 600 MPa.

13. The method of claim 10, wherein the green body is compacted at a compaction pressure of 800 MPa.

14. A method of making a sintered part, comprising:

mixing a cold compaction lubricant and graphite with a water-atomized, pre-alloyed steel powder comprising, in addition to iron and inevitable impurities, by wt %:

1.3-1.7% Cr, 0.15-0.3% Mo, 0.09-0.3% Mn, not greater than 0.01% C, and not greater than 0.25% O;

compacting the mixture at ambient temperature to form a green body; and sintering the compacted green body at a temperature of less than 1200° C.

15. The method of claim 14, wherein the pre-alloyed steel powder comprises not greater than 0.2 wt % O.

16. The method of claim 14, wherein the pre-alloyed steel powder comprises not greater than 0.15 wt % O.

17. The method of claim 14, wherein the compaction pressure is from 400 MPa to 800 MPa.

18. The method of claim 17, wherein the compacted green body has a green density of from 6.75 g/cm$^3$ to 7.38 g/cm$^3$.

19. The method of claim 14, wherein the compacted green body is sintered at a temperature of less than 1150° C.

20. The method of claim 14, wherein the compacted green body is sintered at a temperature of 1120° C.

* * * * *